United States Patent [19]

Lewis

[11] 3,962,936

[45] June 15, 1976

[54] STRAP WRENCH

[76] Inventor: Wade H. Lewis, Box 3265, Lakeland, Fla. 33802

[22] Filed: July 9, 1975

[21] Appl. No.: 594,444

[52] U.S. Cl. ..... 81/64
[51] Int. Cl.[2] ..... B25B 13/52
[58] Field of Search ..... 81/64, 3.43

[56] References Cited

UNITED STATES PATENTS

| | | | |
|---|---|---|---|
| 701,489 | 6/1902 | Love | 81/64 |
| 1,478,110 | 12/1923 | Ellison | 81/64 |
| 2,186,430 | 1/1940 | Richter | 81/64 |
| 2,458,393 | 1/1949 | Loudfoot | 81/64 |
| 2,995,965 | 8/1961 | Hockney | 81/64 |

*Primary Examiner*—James L. Jones, Jr.

[57] ABSTRACT

Strap wrench having both loose ends mounted in a sliding fit through a slot of a rotatable wrenching member, that member being slided to adjust the size of the bight to fit about a large annular body so that rotation of the wrenching member tightly grips the secured bight around the annular body and turns it in either wrenching direction.

5 Claims, 4 Drawing Figures

STRAP WRENCH

The invention relates to a strap wrench and particularly is directed to construction of a strap wrench improved in economy of construction, as well as simplicity and efficiency in operation as a strap wrench, by having both ends of a flexible strap readily secured in adjusted size about an annular body to be turned. The strap is operated through an engaging and wrenching member for turning the annular body by fixing and gripping adjusted portions of the strap as a bight, adjusted to correspond to the approximate circumference of an annular body, to be turned by the strap. The engaging-wrenching member engages and fastens the bight of the strap in a tight gripping position, secured by the turning movement of the wrenching member, for rotation of the annular body to be turned. Particularly, the improved construction hereof usefully engages, fixes and adjusts the dimensions of the bight between both ends of the strap for applying the wrenching movement for turning of a larger annular body in either fastening or unfastening direction.

It is known in the art of strap wrenches to use a chain or flexible strap having one end fixed and another end, after mounting about an annular body, loose for frictionally engaging the annular body for turning by a levering element. That known construction has several disadvantages, particularly in that the strap for mounting about the annular body, for instance mounting or dismounting of a cylindrically shaped oil filter on an engine, the annular circumference is usually the same for most of them, so that the strap and gripping elements will usually engage and grip the flexible strap repeatedly at one point, and the usual biting engagement upon that point soon destroys the strap. That biting engagement at the same point is caused by the strap being bound to the fastening lever with one end fixed so that the strap body becomes worn by being gripped at the same point by the fastening means.

According to the present invention, both ends of the strap are loose and so the bight of the strap is variously selected at any position, and may fit about the circumference of any sized annular body to be turned, and in varying positions with respect to the ends of the flexible strap, whereby there is little or no wear in continued use. That is, no extraordinary wear takes place upon the strap in turning annular objects of the same size because the exact positioning of the bight of the strap with respect to the gripping means will vary in each use at the whim of the user. That kind of construction also provides easier use of this strap wrench, since the user may apply the strap around an annular body wherever it is positioned, often with relatively poor accessibility; and is also useful for various shapes of annular bodies. It is useful for turning an oil filter, an ovate shaped body such as an exhaust gas muffler, a smaller rubber hose or the like or for turning pipe of various sizes. Each of these uses require turning movement of the annular body for application, loosening or removal by a wrench, most handily a strap wrench applicable about the annular body in difficulty accessible positions.

Consequently, the invention here is in a flexible strap combined with an engaging member for both ends and slideable upon two thicknesses of the strap, adjustable to position the bight firmly about the annular body. The engaging-wrenching member is a functionally strong body, such as a metallic cylinder having a slot disposed intermediate at at least one end and passes diametrically through the center. This slot is sized slidingly to receive both ends of a flexible strap leaving a bight or loop, to be dimensioned and positioned by the engaging member as desired with respect to each strap end, for mounting about the circumference of the annular body to be turned. The engaging member is slotted to form a socket or is hexagonally shaped at one or both ends to receive a wrench whereby it is rotated or twisted upon the strap axial of its length while having both ends held in the slot. In this manner, with the strap bight held tightly around the annular body and with the ends of the strap secured by the engaging member dimensionally fixed, as the strap is passed in snug fit about the annular body, the engaging-wrenching member is twisted, both to tighten as well as turn the bight of the strap and annular body therein. When twisting or wrenching, the slot ends bite into each side of the strap passed through its slot, thus grips the strap, and with continuing torque applied about the annular member engaged by the strap, will rotate it, fastening or unfastening in either direction as the wrench twists the fastening member.

The invention is further described in reference to the drawings herein:

Figure 1:
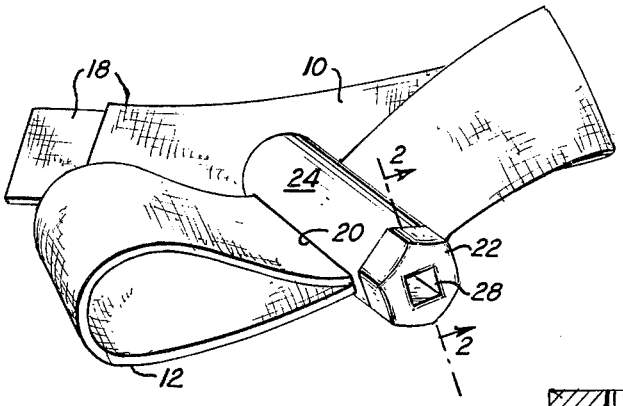
FIG. 1 shows the combined strap and wrenching-engaging member for use.
Figure 2:
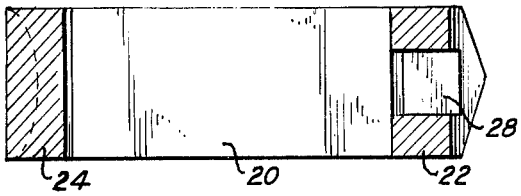
FIG. 2 is section through the engaging member on the lines 2 of FIG. 1 to show the internal slot.
Figure 3:
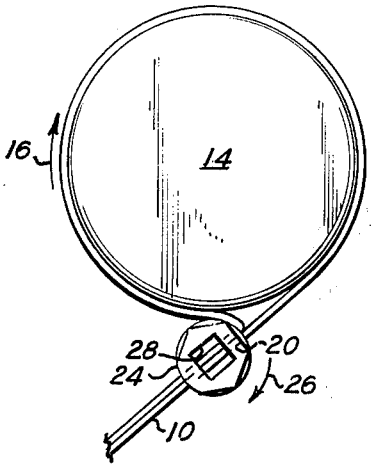
FIG. 3 shows the strap mounted about a cylindrical body for turning in the preliminary engaging position at the start.
Figure 4:
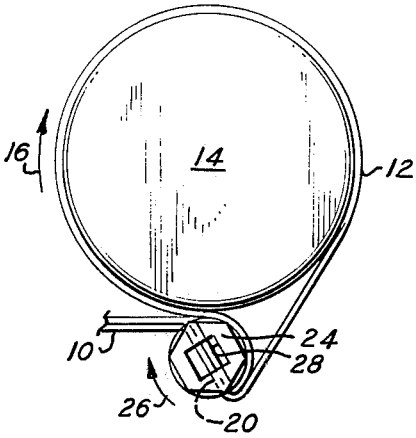
FIG. 4 shows a more advanced rotational position than that of FIG. 3, in which the turning motion applied by a continuing wrenching twist upon the cylindrical body has progressed.

Referring to the drawings, a strap member 10 has a loop in the area 12 which will be mounted about an annular body 14, such as an oil filter, for rotation, as shown in full lines in FIGS. 3 and 4, counterclockwise in the direction of the arrows 16. The ends of the strap 18 are threaded through a slot 20 cut diametrically through the center of a cylindrical engaging and wrenching member 24 as further shown in FIG. 2. The cylindrical wrenching member 24 is manually and easily slided on the strap, reducing the size of the loop or bight 12 drawn in the close fit about the cylindrical surface of the annular body 14 to be turned. It requires only the loose bight portion in the strap 12 to be looped about the circumference of the annular body 14 parallel or co-axial with its rotary axis.

The gripping, engaging and wrenching member 24 is held in one hand and the ends of the strap 18 sliding through slot 20 in the other, and the wrenching member is then slided upon the straps passing through its central slot 20 until the strap is drawn close about the annular body 14 to be turned.

The cylindrical wrenching member has a hexagonal nut or other polygonal shaped portion 22 at at least one end and sometimes both ends (not shown), so that it may be gripped by an end wrench whereby the entire cylindrical wrenching member 24 is gripped thereby and rotated as shown in FIGS. 3 and 4, in the direction of the arrows 26. This rotating motion twists the strap so that the edges of the slot 20 in the cylindrical wrenching member 24 grips the loose ends 18 in rotation and the portion of the strap passed through the slot. The slot edges bite into the strap, fixing the loose ends firmly thereby as the cylindrical wrenching member is rotated, and further secures the strap tightly about the annular body 14 as they rotate together. Thus, as the wrenching force is continued to be applied, rotating the wrenching member 24 in the direction of the arrows 26 with the strap around, tightening upon and engaging the annular body 14, rotates with the strap. Similarly for applying wrenching force in the opposite direction to these arrows the wrenching member 24 and the annular body 14 will be rotated in the opposite direction to these arrows, and the ends of the strap thus will be similarly gripped, but the wrenching cylinder will be rotated in exact opposite manner, and the annular body 14 then will be rotated in the opposite direction.

The structure allows application of rotary force to annular structures disposed for rotation, in quite remote areas, often of difficult accessibility to ordinary wrenches. A socket-type wrench having a squared end may be fitted into a square depression 28 cut in one end of the wrenching member 24, whereby the desied force can be applied from a remote point with a socket-type wrench. Similarly that kind of wrench can have any polygonal shape such as a hexagonal socket to fit around the outer hexagonal stud portion of the wrench. For instance, the inner square socket portion 28 can be sized to about ½ inch to take a socket wrench end shaped to fit therein, and the outer hexagonal cut portion 22 of the cylinder can be sized to fit a ⅞ inch wrench, either larger or smaller as is convenient.

The flexible strap useful in this invention may be varied in strength and texture for easy availability. For instance, a piece cut from a seat belt or shoulder harness, available protectively in modern automobiles, can be used as the strap portion of this wrench.

As thus described a strap wrench is provided, substantially improved in economy and simplicity of construction, as well as in simplicity of application to apply about an annular body, an oil filter, a pipe or hose, for applying a rotary motion to such large annular bodies disposed in relatively inaccessible positions, usually found about an automobile. The present strap wrench may be useful for applying that rotary motion in either direction upon the annular body with substantial wrenching torque for tightening or loosening, using an easily replaceable flexible belt as the strap, and particularly one easily mounted with its bight adjusted manually to quickly fit about any annular body in relatively inaccessible positions.

It will be understood that while the annular body may be round, that is cylindrical, it could be ovate or even be composed of several flat sides, rectangular or polygonal for gripping by the bight of the strap mounted thereabout for its rotation.

Similarly, while the wrenching member 24 is shown to by cylindrical, it would also operate if it were ovate or one or more of the sides were flat, such as polyhedral, hexagonal or the like. Moreover, while the slot is usefully cut diametrically through the center from side to side, it can be off center of the cylinder or other similarly shaped body as stated for gripping of strap ends passing through such slot.

Accordingly, it is intended that the description given herein is regarded as exemplary and not limited except as defined in the claims.

I claim:

1. A strap wrench comprising a flexible belt or strap, a rotatable elongated annular fastening-wrenching member having a slot therein passing diametrically through the mid-section and extending from side to side through the annular walls thereof, said slot forming strap gripping edges at each intersection with said annular walls and being sized wider than the combined thicknesses of two strap plies to slidingly receive both ends of the strap and be slidingly positionable thereon to form a bight portion between the strap ends leaving both strap ends free, said strap bight being mountable about and adjusted by the position of said wrenching member to fit about an annular body to be turned herewith, and means upon said fastening-wrench member for receiving and being gripped by the end of a wrench for turning said fastening-wrenching member radially upon its axis into gripping engagement of the edges of said slot with the sides of said strap.

2. The strap wrench as defined in claim 1, wherein said strap is a woven fabric of size and character of a seat belt.

3. The strap wrench as defined in claim 1, wherein the fastening-wrenching member is cylindrical and the slot therein is cut intermediate to its axial ends and passes diametrically through the center from side to side thereof.

4. The strap wrench as defined in claim 1, wherein the fastening-wrenching member has at least one end shaped as a hexagonal nut for receiving and being twisted by the jaws of a correspondingly sized wrench.

5. The strap wrench as defined in claim 1, wherein the fastening-wrenching member has at least one end cut axially inward as a rectangular or hexagonal socket to receive the end of a correspondingly sized wrenching member for applying a turning wrenching motion to said member.

* * * * *